US005164631A

United States Patent [19]

Lee

[11] Patent Number: 5,164,631

[45] Date of Patent: Nov. 17, 1992

[54] CATHODE STRUCTURE FOR AN ELECTRON TUBE

[75] Inventor: Kyung Sang Lee, Kyungsangbuk, Rep. of Korea

[73] Assignee: Goldstar Co., Ltd., Seoul, Rep. of Korea

[21] Appl. No.: 753,166

[22] Filed: Aug. 30, 1991

[30] Foreign Application Priority Data

Aug. 30, 1990 [KR] Rep. of Korea ..... 90-13173

[51] Int. Cl.[5] ..... H01J 19/42

[52] U.S. Cl. ..... 313/270; 313/337; 313/346 R; 313/446

[58] Field of Search ..... 313/270, 337, 346 R, 313/446

[56] References Cited

U.S. PATENT DOCUMENTS 2,146,365 2/1939 Batchelor ..... 313/337

4,588,254 12/1985 Opresko ..... 313/270

FOREIGN PATENT DOCUMENTS 2654554 6/1978 Fed. Rep. of Germany ..... 313/270

*Primary Examiner*—Donald J. Yusko

*Assistant Examiner*—Nimesh Patel

*Attorney, Agent, or Firm*—Morgan & Finnegan

[57] ABSTRACT

The present invention involves a cathode structure for an electron tube wherein the cathode sleeve and cathode sleeve holder are fixed together by improved means so as to increase the exposed length of the cathode sleeve that has a cathode heater, a cathode holder for holding the cathode heater, a cathode sleeve with an upper end and lower end for enclosing the cathode heater, the upper end sealed by a cathode cap, a cathode sleeve holder with an upper end and lower end for holding the lower end of the cathode sleeve and the cathode holder, an outward flange formed around the lower end of the cathode sleeve, and an inward flange from around the upper end of the cathode sleeve holder, wherein in the outward flange of the cathode sleeve is caught by and bonded to the inner flange of the cathode sleeve holder.

3 Claims, 1 Drawing Sheet

CATHODE STRUCTURE FOR AN ELECTRON TUBE

FIELD OF THE INVENTION

The present invention concerns a cathode structure for an electron tube.

BACKGROUND OF THE INVENTION

Generally, a cathode structure for an electron tube used in a TV system, etc., as shown in FIG. 1, comprises a cylindrical cathode sleeve 2 made of Ni-Cr alloy, a cathode cap 1 made of Ni for sealing the upper end of the cathode sleeve 2, an electron emissive substance 4 deposited on the cathode cap 1, a stepped cylindrical cathode sleeve holder 3 with a small diameter portion and large diameter portion, the small diameter portion being fixed on the lower side of the cathode sleeve 2, and a cylindrical cathode holder 5 for holding a cathode heater 6 and the large diameter portion.

In this cathode structure, the cathode sleeve 2 is blackened by oxidizing the Cr contained in the cathode sleeve in order to improve the heat radiation, thereby reducing the time during which the heater 6 is supplied with a voltage so as to cause a picture signal to appear on the screen of the electron tube. In this case, it should be noted that the cathode cap 1, cathode sleeve 2 and cathode sleeve holder 3 are fixed together prior to the blackening of the cathode sleeve 2 because the blackened cathode sleeve 2 is hardly joined with the cathode cap 1 and cathode sleeve holder 3 by resistance welding. Further, the cathode sleeve holder 3 is not blackened so as to be fixed to the cathode holder 5 by resistance welding.

FIG. 3 is a graph for illustrating the temperature changes of the cathode with variation of the exposed length C of the cathode sleeve in the cathode structure. It will be readily appreciated that the cathode temperature increases with increase of the exposed length C. Consequently, this results in reduction of the power consumption of the heater 6 contained in the cathode sleeve 2. However, the conventional cathode structure inherently limits the exposed length C as well as the reduction of the power consumption.

SUMMARY OF THE INVENTION

The object of the present invention is to provide a cathode structure wherein the joining structure of the cathode sleeve and cathode sleeve holder is improved so as to increase the exposed length of the cathode sleeve, thus reducing the power consumption of the heater.

According to the present invention, there is provided a cathode structure for an electron tube comprising a cathode heater, a cathode holder for holding the cathode heater, a cathode sleeve with an upper end and lower end for enclosing the cathode heater, the upper end sealed by a cathode cap, a cathode sleeve holder with an upper end and lower end for holding the lower end of the cathode sleeve and the cathode holder, an outward flange formed around the lower end of the cathode sleeve, and an inward flange formed around the upper end of the cathode sleeve holder, wherein the outward flange of the cathode sleeve is caught by and bonded to the inner flange of the cathode sleeve holder.

The present invention will now be described more specifically with reference to the drawings attached only by way of example.

BRIEF DESCRIPTION OF THE ATTACHED DRAWINGS

FIG. 1 schematically shows a cross-sectional view of a conventional cathode structure for an electron tube;

FIG. 2 is a cross-sectional view of an inventive cathode structure for an electron tube; and FIG. 3 is a graph for illustrating the temperature changes of the cathode cap with variation of the exposed length of the cathode sleeve.

DETAILED DESCRIPTION OF A CERTAIN PREFERRED EMBODIMENT

Figure 1:
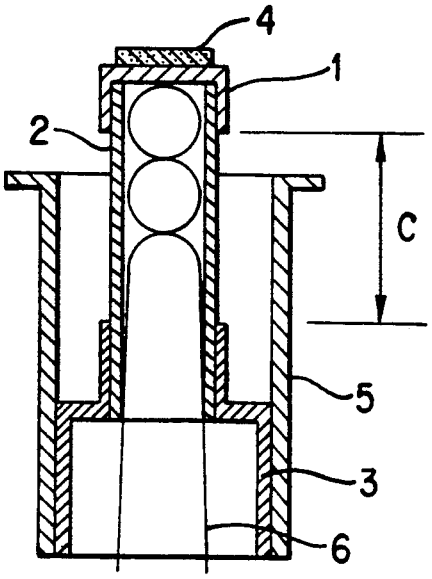
FIG. 1 PRIOR ART
Figure 2:
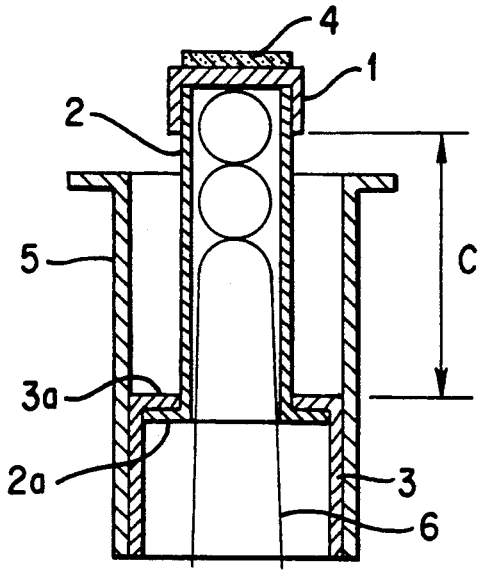

Referring to FIG. 2, there is shown a cylindrical cathode sleeve 2 with an upper end and lower end. The lower end has an integrally formed outward flange 2*a*, and the upper end is sealed by a cathode cap 1 on which is deposited an electron emissive substance 4. A cathode sleeve holder 3 with an inward flange 3*a* formed in the upper end holds the outward flange 2*a* of the cathode sleeve 2 with the inward flange 3*a*. A cylindrical cathode holder 5 encloses the cathode sleeve holder 3. A heater 6 is inserted into the cathode sleeve 2.

The cathode sleeve 2 is held by the cathode sleeve holder 3 by means of the outward flange 2*a* being flatly joined with the inner flange 3*a*. The cathode cap 1 is shaped by pressing, and the cathode sleeve 2 is made of a pipe with an outward flange. The outward flange 2*a* is shaped integrally with the pipe by pressing. The cathode holder 3 is made of a cap shaped by pressing. A central opening is formed in the cap so as to form the inward flange 3*a*.

The cathode cap 1, cathode sleeve 2 and cathode sleeve holder 3 are properly fixed together by laser or resistance welding. Thereafter the cathode sleeve is blackened. The electron emission substance 4 is desposited on the cathode cap 1, and the cathode sleeve 2 is fixed inside the cylindrical cathode holder 5. The heater 6 is inserted into the cathode sleeve 2.

Figure 3:
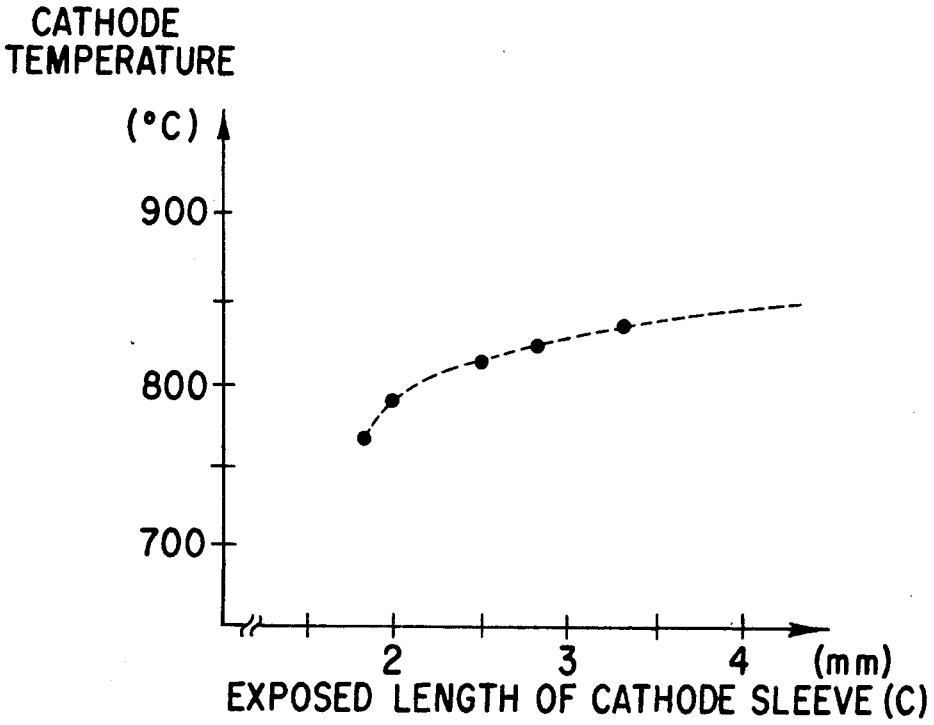

As stated above, in accordance with the present invention, the cathode sleeve holder 3 fixedly holds the cathode sleeve 2 by means of the inner flange 3*a* and outer flange 2*a*, so that the length of the cathode sleeve 2 is substantially wholly exposed, thus increasing about 1.5 mm more than that of the conventional cathode structure. Hence, as shown in FIG. 3, the cathode temperature measured at the cathode cap 1 increases about 50° C. more than the conventional one. Consequently, the power consumption of the cathode heater is considerably reduced.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A cathode structure for an electron tube comprising:

an electron emissive portion and a cathode heater;

a cathode holder for holding said cathode heater;

a cathode sleeve with an upper end and lower end for enclosing said cathode heater, said upper end sealed by a cathode cap;

a cathode sleeve holder with an upper end and lower end for holding the lower end of said cathode sleeve and said cathode holder;

an outward flange formed around the lower end of said cathode sleeve; and an inward flange formed around the upper end of said cathode sleeve holder, wherein said inward and outward flanges each having a horizontally disposed portion adapted for contact with the corresponding horizontal portion of the other flange, said contacting flanges being bonded to one another.

2. The cathode structure according to claim 1, wherein said outward flange is mounted on an upper surface of said horizontal portion of said inward flange.

3. The cathode structure according to claim 1, wherein said outward flange is mounted on a lower surface of said horizontal portion of inward flange.

* * * * *